United States Patent [19]

Sowards et al.

[11] Patent Number: 4,778,351

[45] Date of Patent: Oct. 18, 1988

[54] UNLOADER, AND IN COMBINATION WITH AN AIR COMPRESSOR INLET HOUSING

[75] Inventors: Brian D. Sowards, Mocksville; Frederick H. Emilson, Lexington, both of N.C.

[73] Assignee: Ingersoll-Rand Company, Woodcliff Lake, N.J.

[21] Appl. No.: 69,913

[22] Filed: Jul. 6, 1987

[51] Int. Cl.[4] ..... F04B 49/02; F16K 31/122

[52] U.S. Cl. ..... 417/295; 251/62; 251/63.5

[58] Field of Search ..... 417/295; 251/62, 63.5, 251/63.6; 92/107

[56] References Cited

U.S. PATENT DOCUMENTS

| | | | |
|---|---|---|---|
| 2,913,005 | 11/1959 | Grant et al. | 92/107 |
| 2,926,883 | 1/1960 | Prybylski et al. | 92/107 |
| 3,141,386 | 7/1964 | Loughridge | 92/107 |
| 4,270,885 | 6/1981 | Schneffer et al. | 417/295 |
| 4,362,475 | 12/1982 | Seitz | 417/295 |
| 4,473,093 | 9/1984 | Hart | 417/295 |
| 4,523,516 | 6/1985 | Foster et al. | 92/107 |

FOREIGN PATENT DOCUMENTS

| | | | |
|---|---|---|---|
| 1009496 | 11/1965 | United Kingdom | 251/63.6 |

*Primary Examiner*—William L. Freeh

*Attorney, Agent, or Firm*—Bernard J. Murphy

[57] ABSTRACT

The unloader has a piston-operated valving element which opens and closes a compressor, air inlet housing, inlet port to load and unload the associated compressor. A control, pressured air supply is addressed to the piston to cause the latter to translate the valving element into port closure, and in the absence of the aforesaid supply, vacuum pressure and incoming air displace the valving element from closure of the ports. One spring seats the piston, and another moves the valving element into closure when the compressor is shut down, in one embodiment of the invention. A guide rod pilots movements of the piston and valving element. In the combination, the unloader is wholly confined within an aluminum die-cast air inlet housing.

14 Claims, 2 Drawing Sheets

UNLOADER, AND IN COMBINATION WITH AN AIR COMPRESSOR INLET HOUSING

The invention pertains to air compressor controls, and in particular to air compressor unloaders.

In the prior art, it is conventional to affix unloaders, externally, upon the air inlet port of an air compressor. Of course, this requires the independent fabrication of the unloader housing, its bolt-holing and gasketing, and the like. Too, it presents an obstruction subject to inadvertent damage.

It would be most desirable to be able to omit the fabrication of the housing, the sealing and bolting, and the ungainly obstruction of an affixed unloader. Too, it would be quite advantageous to form air compressor inlet housings, in fact whole air compressor housings, through aluminum die-cast construction.

With the aforesaid in mind, it would be ideal to be able to confine an unloader wholly within an aluminum die-cast, air compressor inlet housing. However, parts designed to be die cast have more demands placed on their configuration than sand-cast parts. The die has to be able to pull out of the part after it is cast and this creates problems. Undercuts and hidden pockets just will not work in a die casting. Yet, incorporating the most expensive part of an unloader (the main housing part of it) directly into the compressor inlet housing would provide the main unloader housing for free (without having bolts and gaskets to mount it to the compressor). Prior art manufacturers integrate unloader housings into their compressor housings but these are cast-iron designs. Undercuts and trapped pockets therein could not die-cast unless the housings were "broken up" into a few separate pieces.

It is an object of this invention to disclose a unitized, aluminum, die-cast, air compressor inlet housing having, in combination therewith, and wholly confined therewithin, an efficient unloader of few parts.

It is particularly an object of this invention to set forth, in combination, an inlet housing of an air compressor having an inlet port and a passage port, and an unloader within said housing, comprising a chamber, within said housing, having a circumferential wall; and a cover plate, atop said chamber, having said inlet port formed therein; wherein said passage port is formed in said wall; and further including a base in said chamber, opposite said cover plate, having a recess formed therein; a valving element for opening and closing said inlet port; wall means, set in said recess and movable therewithin, for engaging and displacing said element; guide means for piloting (a) displacement of said element, and (b) element engaging and displacing movement of said wall means; wherein said element and said wall means are slidably engaged with said guide means; and further including given means, interposed between said element and one of said wall and guide means, for urging said element in a given direction.

It is also an object of this invention to disclose a uniquely simplified, albeit efficient unloader for emplacement wholly within the inlet housing of a gas compressor, comprising a valving element; wall means movable for engaging and displacing said element; guide means for piloting (a) displacement of said element, and (b) element engaging and displacing movement of said wall means; wherein said element and said wall means are slidably engaged with said guide means; and further including given means, interposed between said element and one of said wall and guide means, for urging said element in a given direction.

Further objects of this invention, as well as the novel features thereof, will become more apparent by reference to the following description taken in conjunction with the accompanying figures, in which.

Figure 1:
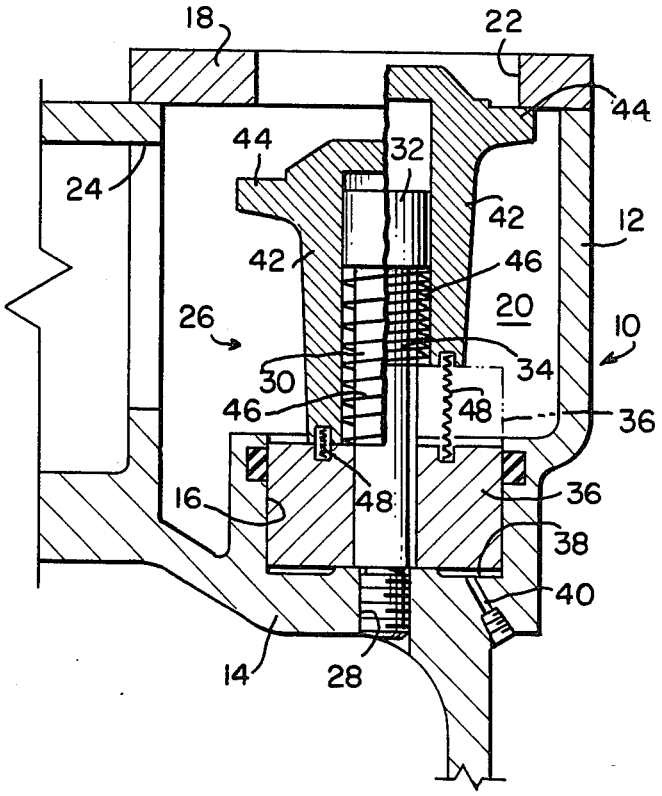
FIG. 1 is a cross-sectional view taken through an aluminum die-cast, inlet housing of an air compressor and showing a first embodiment of the novel unloader wholly confined therewithin; the figure is "split" to show the valving element in closure, on the right-hand side, and open on the left-hand side.

As shown in FIG. 1, an aluminum die-cast inlet housing 10 has a straight, circumferential wall 12, and a base 14 in which has been formed a straight cylindrical recess 16. A cover plate 18 closes off the housing chamber 20, except that the plate 18 has the air inlet port 22 formed therein. The wall 12 has a further, air-conducting passage port 24 formed therethrough.

It is to be noted that housing 10 has no trapped pockets and, accordingly, lends itself to aluminum die-casting. The unloader 26 is accommodated wholly therewithin.

Base 14 has a tapped hole 28 formed therein which receives the threaded end of a guide rod 30. Rod 30 has a large diameter head 32 and a smaller diameter shank 34. The shank 34 slidably receives a centrally-bored, circular piston 36; the piston 36 also nests in the recess 16. The piston 36 and base 14 define a variable-volume subchamber 38 therebetween, and a base-traversing passageway 40 opens onto subchamber 38.

The head 32 of the guide 30 slidably receives the hollow interior of a valving element 42. Element 42 has a radially-extended land 44 which closes against the plate 18 to close off port 22.

Control, pressured air, provided from a source (not shown), according to well-known, prior art practices, is admitted via passageway 40 when it is desired to unload the compressor. Such control air pressurizes subchamber 38 and, consequently, causes the piston 36 to slide along the shank 34, and (as shown in dashed outline) carries the valving element 42 therewith into closure of port 22.

In the absence of such control air, the compressor vacuum pressure and the inlet air displace the valving element 42 from the port 22 and the latter, thus, is opened to port 24.

A compression spring 46 envelops the shank 34 and bears, at the ends thereof, against the head 32 and piston 36. Spring 46 functions to return piston 36 to its bottomed seating in the recess 16.

Another, cylindrical compression spring 48 is interposed between the piston 36 and valving element 42. This spring serves to move the valving element 42 into its closed positioning when the associated air compressor is shut down.

Figure 2:
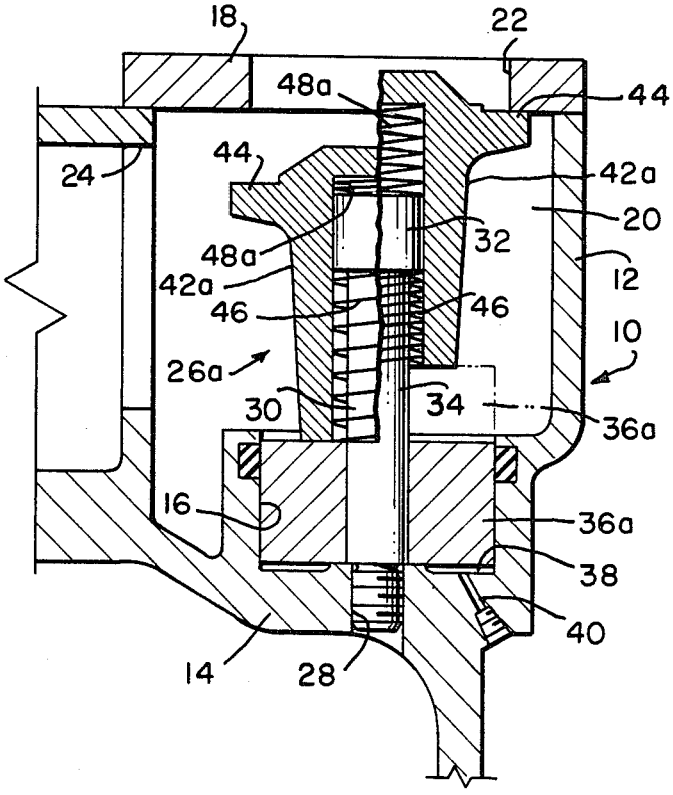
FIG. 2 is an illustration like that of FIG. 1, but of a second embodiment of the novel unloader.

The embodiment of FIG. 2 is very similar to that of the FIG. 1 version, and the same or similar index numbers therein denote same or similar components. The significant difference herein is represented by the valve shutdown spring 48*a*. Here it is confined between the head 32 and the hollow of the valving element 42*a*. In this disposition, the spring 48*a* is less subject to corrosion from moisture and detritus in the inlet air.

Figure 3:
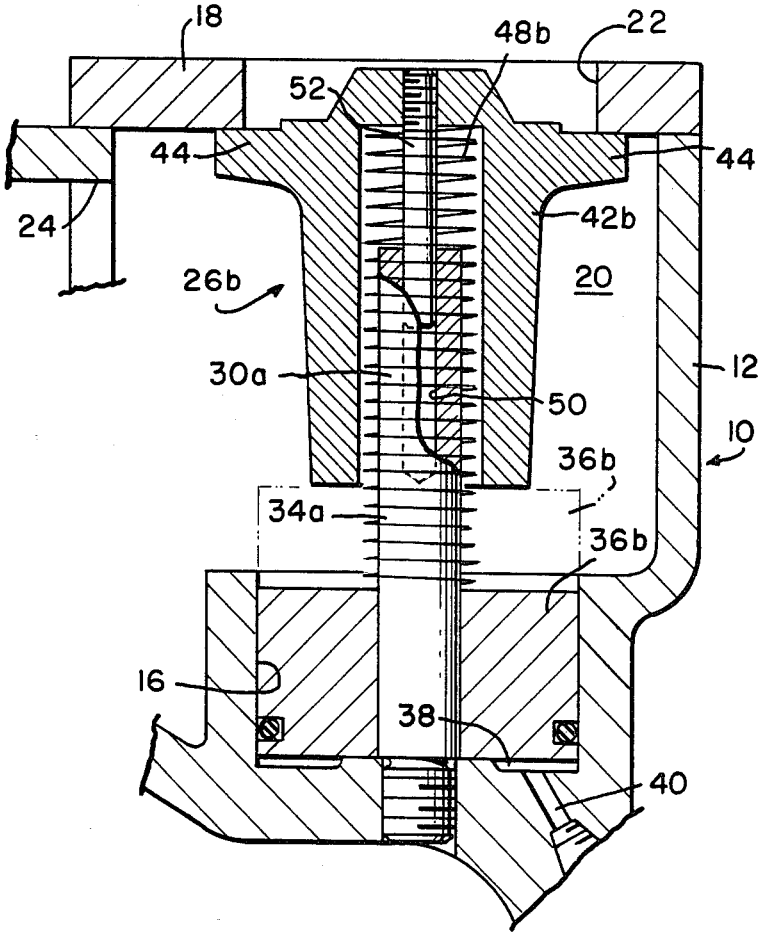
FIG. 3 is an illustration similar to the prior two (which, however, is not "split"), depicting a third embodiment of the inventive unloader.

The FIG. 3 embodiment employs a single spring 48*b* to serve the purposes of both springs 46 and 48 (and 48*a*) of the prior embodiments. Again, herein same or similar index numbers signify same or similar elements as in the earlier-described and depicted embodiments.

In this third embodiment, the guide rod 30*a* has an axial bore 50 formed therein slidably, and pilotingly, to receive a guide pin 52 which is threaded into the head of the valving element 42*b*.

One will note that any of the three embodiments can be emplaced into the housing 10 from the top (i.e., with the cove plate 28 removed), each is of simple assemblage, and all have a minimum of parts.

While we have described our invention in connection with specific embodiments thereof, it is to be clearly understood that this is done only by way of example, and not as a limitation to the scope of our invention as set forth in the objects thereof and in the appended claims.

We claim:

1. An unloader, for emplacement wholly within the inlet housing of a gas compressor, comprising:

a valving element;

wall means movable for engaging and displacing said valving element;

guide means for (a) piloting displacement of said valving element, and (b) also for piloting movement of said wall means; wherein said valving element and said wall means are slidably engaged with said guide means; and further including biasing means, interposed between said valving element and one of said wall and guide means, for urging said valving element in a given direction; and wherein said valving element comprises a cylinder having a hollow, longitudinal interior and being closed at one end; and said guide means is received within said hollow interior of said cylinder.

2. An unloader, according to claim 1, wherein:

said given urging means is interposed between said element and said wall means.

3. An unloader, according to claim 1, wherein:

said given urging means is interposed between said element and said guide means.

4. An unloader, according to claim 1, wherein:

said guide means comprises a guide rod;

said rod has a plurality of surfaces, each with a different outside diameter;

said wall means is slidably engaged with one of said surfaces; and said valving element is slidably engaged with another of said surfaces.

5. An unloader, according to claim 1, further including:

further means, interposed between said wall and guide means, for urging said wall means in a prescribed direction.

6. An unloader, according to claim 2, wherein:

said given urging means and said further urging means bias said element and said wall means, respectively, in opposite directions.

7. An unloader, for emplacement wholly within the inlet housing of a gas compressor, comprising:

a valving element;

wall means movable for engaging and displacing said valving element;

guide means for piloting both (a) displacement of said valving element, and (b) movement of said wall means; wherein said valving element and said wall means are slidably engaged with said guide means; and further including a biasing element, interposed between said valving element and one of said wall and guide means, for urging said valving element in a given direction; and wherein said valving element comprises a cylinder which (a) has a hollow, longitudinal interior, and (b) is closed at one end; and said guide means is received within said hollow interior of said cylinder.

8. An unloader, according to claim 7, wherein:

said biasing element is interposed between said valving element and said wall means, and comprises means for urging said wall means in a direction which is opposite said given direction.

9. An unloader, according to claim 7, wherein:

said wall means comprises a piston.

10. An unloader, according to claim 7, wherein:

said guide means comprises a guide rod; and said biasing means comprises an annular compression spring circumjacent said guide rod.

11. An unloader, according to claim 7, wherein:

said guide means comprises a guide rod, said rod having a bore formed therein, and a guide pin, coupled to said valving element, slidably engaged with said bore.

12. An unloader, according to claim 11, wherein:

said biasing element comprises an annular compression spring circumjacent said guide rod.

13. In combination, an inlet housing of an air compressor having an inlet port and a passage port, and an unloader wholly confined within said housing, comprising:

a chamber, within said housing, having a circumferential wall; and a cover plate, atop said chamber, having said inlet port formed therein; wherein said passage port is formed in said wall; and further including a base in said chamber, opposite said cover plate, having a recess formed therein;

a valving element for opening and closing said inlet port;

wall means, set in said recess and movable therewithin, for engaging and displacing said valving element;

guide means, coupled to said base, for piloting both (a) displacement of said valving element, and (b) movement of said wall means; wherein said valving element and said wall means are slidably engaged with said guide means, and further including biasing means, interposed between said valving element and one of said wall and guide means, for urging said valving element in a given direction; and wherein said valving element comprises a cylinder having a hollow, longitudinal interior and being closed at one end; and said guide means is received within said hollow interior of said cylinder.

14. The combination, according to claim 13, wherein:

said wall means comprises a piston; and said piston and said base define a variable-volume sub-chamber therebetween; and further including a fluid-conductive passageway opening through said base and into said sub-chamber.

* * * * *